US006681599B2

(12) United States Patent
Meguro

(10) Patent No.: US 6,681,599 B2
(45) Date of Patent: Jan. 27, 2004

(54) JEWELRY PENDANT

(75) Inventor: Takefumi Meguro, Tokyo (JP)

(73) Assignee: Gem Network, Ltd., Tokyo (JP)

( * ) Notice: Subject to any disclaimer, the term of this patent is extended or adjusted under 35 U.S.C. 154(b) by 0 days.

(21) Appl. No.: 10/102,898

(22) Filed: Mar. 22, 2002

(65) Prior Publication Data

US 2002/0134107 A1 Sep. 26, 2002

(30) Foreign Application Priority Data

Mar. 23, 2001 (JP) ..... 2001-086471

(51) Int. Cl.[7] ..... A44C 17/02
(52) U.S. Cl. ..... 63/31; 63/26; 63/23
(58) Field of Search ..... 63/26, 31, 12, 63/13, 23

(56) References Cited

U.S. PATENT DOCUMENTS 483,214 A * 9/1892 Gaynor ..... 63/13
922,212 A * 5/1909 Tropin ..... 63/31
1,211,240 A * 1/1917 Ryan ..... 63/26
4,028,908 A * 6/1977 Michael ..... 63/23
4,220,017 A * 9/1980 Freeman ..... 63/15
4,726,200 A * 2/1988 Carter ..... 63/15
5,974,831 A * 11/1999 Afuku et al. ..... 63/26
6,006,547 A * 12/1999 Bergagnini ..... 63/26

* cited by examiner

*Primary Examiner*—Andrea Chop
(74) *Attorney, Agent, or Firm*—Wenderoth, Lind & Ponack, L.L.P.

(57) ABSTRACT

A jewelry pendant includes a flat anchor portion provided on the back surface of a pedestal that includes a chain connecting portion formed in an upper part thereof. A suspension portion is formed in a projecting manner on the front surface of the pedestal at substantially the center position thereof, and a suspension hole is formed at the tip of the suspension portion. A decorative piece is swingably suspended through the suspension hole.

22 Claims, 6 Drawing Sheets

JEWELRY PENDANT

BACKGROUND OF THE INVENTION

1. Field of the Invention

The present invention relates to a jewelry pendant used by suspending a decorative piece to which a jewel or the like is mounted.

2. Description of the Related Art

Conventionally, there are various types of jewelry pendants with a variety of shapes. Among these, a typical jewelry pendant consists of a necklace chain to be placed around a neck of a wearer, and a decorative piece to which a jewel such as a diamond is mounted. Depending on a type of such a jewelry pendant, the decorative piece is suspended from the necklace chain through a loop ring, or both ends of the necklace chain are directly fixed to the decorative piece.

As an example, shown in FIG. 1 is a jewelry pendant 1 in which a decorative piece 2 is suspended from a necklace chain 5. In order to make a jewel 2*a* appear larger and more brilliant, a cylindrical clasp 4 surrounds a girdle portion (not shown) of the jewel 2*a*, and a loop ring 3 is attached on top of the clasp 4, so that when the necklace chain 5 is passed through the loop hole 3, the decorative piece can be supported in a swinging manner.

The above-described jewelry pendant 1 is designed such that the decorative piece 2 is swung as the body of a wearer moves, whereby reflected light from the jewel 2*a* makes subtle changes, lending a beautiful sparkle to the jewel 2*a*. However, since the decorative piece 2 directly abuts a chest A of the wearer, such subtle swing movements of the jewel 2*a* rarely occur even when the body of the wearer is moved. That is, although there may be a case where the pendant itself is swung, the decorative piece 2 is moved to the right or left, or it is even turned over, and thus it is impossible to achieve genuinely brilliant light reflection of the jewel 2*a*. Accordingly, there is a problem in that attractiveness of the jewelry pendant is not fully displayed.

SUMMARY OF THE INVENTION

The present invention has been made in view of the above problem, and therefore an object thereof is to provide a pendant in which a decorative piece makes subtle swing movements as the body of a wearer moves while the pendant is worm, thereby adding sufficient sparkle or brilliance to a jewel or the like mounted to the decorative piece. It is also an object of the present invention to provide a jewelry pendant in which, even when the body of the wearer moves, the pendant itself is not displaced, the decorative piece is not moved to the right or left, or the pendant is not turned over, so that the jewel or the like always faces the front while the pendant is worn.

In order to attain the above object, according to a first aspect of the present invention, there is provided a jewelry pendant characterized in that: a flat anchor portion is defined by a back portion of a pedestal that includes a chain connecting portion formed at an upper part of the pedestal; a suspension portion is defined in a projecting manner by a front portion of the pedestal at substantially a central position thereof, and a suspension hole is formed at a tip of the suspension portion; and a decorative piece is swingably suspended through the suspension hole.

According to a second aspect of the present invention, in the first aspect of the invention, a jewelry pendant is characterized in that: the pedestal as a whole has a shape of a substantially inverted triangle as seen from the front; the anchor portion is gently tapered in a vertical direction thereof as seen from the side; and the suspension portion is formed such that its tip portion is located at a most extended position as seen from the side, and a curved portion that is recessed rearwardly is formed in a lower part of the suspension portion.

According to a third aspect of the present invention, in the first aspect of the invention, a jewelry pendant is characterized in that: both upper side edges of the pedestal are spread like a wing as seen from the front to thereby form a chain connecting portion defined by oppositely extending extensions, and both ends of a necklace chain are fixed to the chain connecting portion; the anchor portion is gently tapered in a vertical direction thereof as seen from the side; and a suspension portion is formed such that its tip portion is located at a most extended position as seen from the side, and a curved portion that is recessed rearwardly is formed in a lower part of the suspension portion.

According to a fourth aspect of the present invention, in any one of the first to third aspects of the invention, a jewelry pendant is characterized in that: the decorative piece consists of a jewel, a stopping ring surrounds a girdle portion of the jewel, and a loop ring is attached above the stopping ring; and the loop ring is engaged with the suspension hole to swingably suspend the decorative piece from the pedestal.

According to a fifth aspect of the present invention, in any one of the first to third aspects of the invention, a jewelry pendant is characterized in that: the decorative piece consists of a jewel, a plurality of claw portions supports the jewel, a stopping ring surrounds a pavilion portion of the jewel, and a loop ring is attached above the stopping ring; and the loop ring is engaged with the decorative piece to swingably suspend the decorative piece from the pedestal.

DETAILED DESCRIPTION OF THE PREFERRED EMBODIMENTS

Figure 1:
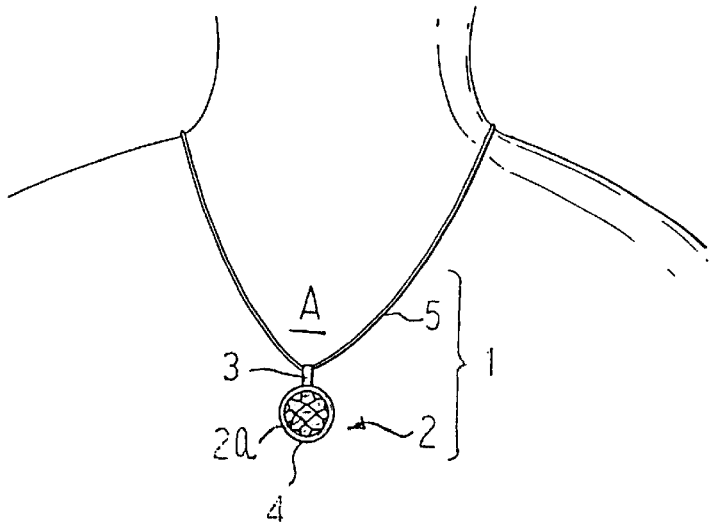
FIG. 1 (PRIOR ART)
FIG. 1 is a front view showing a state where a conventional jewelry pendant is worm.
Figure 2:
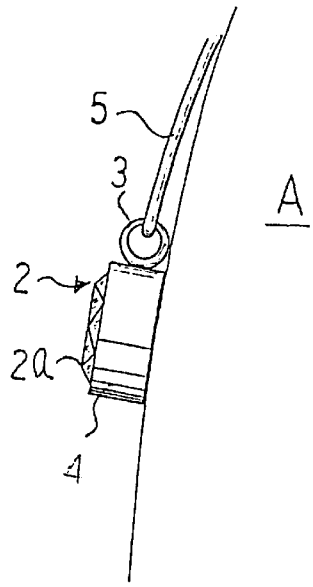
FIG. 2 (PRIOR ART)
FIG. 2 is an enlarged side view showing a state where the conventional jewelry pendant is worm.
Figure 3:
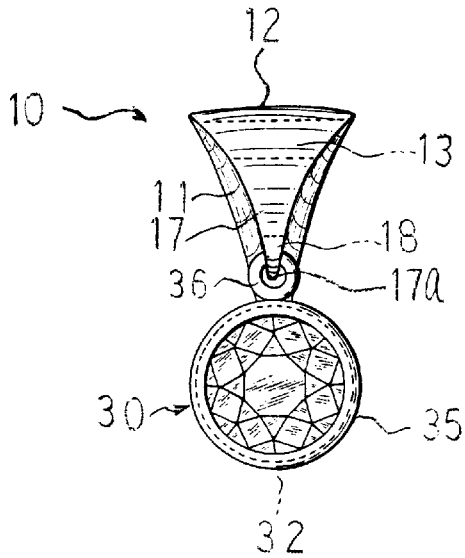
FIG. 3 is a front view of a first jewelry pendant according to the present invention.
Figure 4:
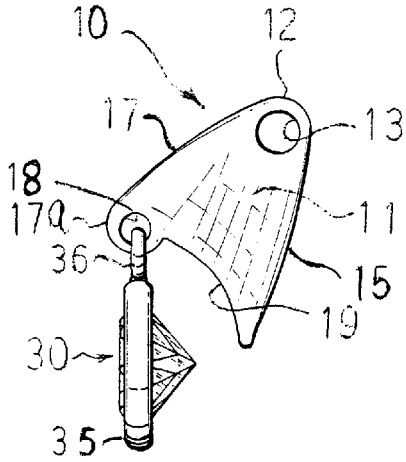
FIG. 4 is a side view of the first jewelry pendant according to the present invention.

Embodiments of a jewelry pendant according to the present invention will be described hereinbelow with reference to the drawings. FIG. 3 shows a first embodiment of the present invention and is a front view of a first jewelry pendant in which a first decorative piece is mounted to a first pedestal. FIG. 4 is a side view thereof.

Figure 13:
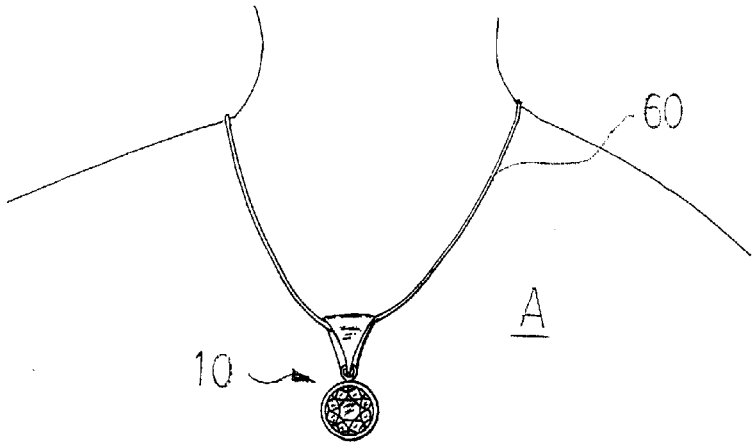
FIG. 13 is a reference drawing illustrating a state where the second jewelry pendant is worm.

The first jewelry pendant 10 is composed of: a pedestal 11 formed of a precious metal such as gold, silver, or platinum, or a metal such as brass; a first decorative piece 30 having a jewel such as a diamond, emerald, or ruby mounted thereto; and a necklace chain 60 formed of the same precious metal or the like described above in order to suspend the decorative piece 30 over a wearer's chest A (see FIG. 13).

As shown in FIG. 3, the pedestal 11 of the first jewelry pendant 10 generally defines a vertically extending inverted triangle as seen from the front. A through hole 13 is formed along a width of a chain connecting portion provided in a wide head portion 12 of the pedestal 11. The necklace chain 60 is passed through the through hole 13 when the jewelry pendant 10 is worn. If the through hole running though the chain connecting portion is enlarged, a necklace chain having a larger diameter, a plurality of small-diameter necklace chains that are twined together, a pearl necklace or the like may be passed through the through hole.

Figure 8:
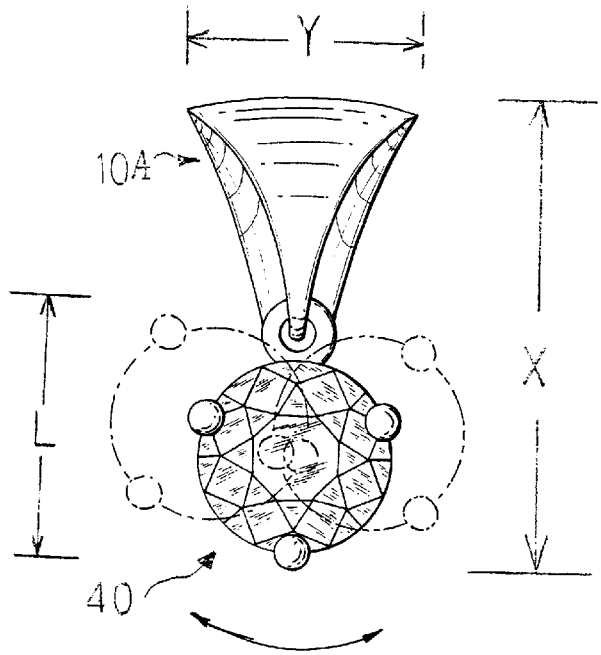
FIG. 8 is a front view illustrating dimensional balance of the second jewelry pendant as a whole and a swinging state of a decorative piece.

Since the pedestal 11 has a shape of an inverted triangle, it is possible to maintain balance among a dimension L of the decorative piece 30 to be suspended, a vertical length X of the overall pendant, and a lateral width Y of the overall pendant so that when the decorative piece 30 is suspended from the pedestal 11, it can be always placed at a lower position in a stable fashion (see FIG. 8).

Figure 14:
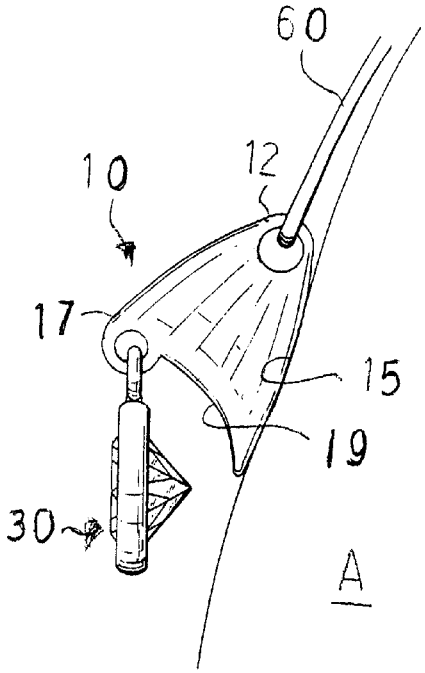
FIG. 14 is an enlarged view illustrating a state where the second jewelry pendant is worn.

Reference numeral 15 denotes a flat anchor portion defined by a back portion of the pedestal 11, as shown in FIG. 4. When seen from the side, the anchor portion 15 is gently tapered in a vertical direction thereof. Since this shape of the anchor portion 15 conforms with a curve A of the wearers chest while the jewelry pendant is worm, the entire anchor portion 15 and the chest A of the wearer can be brought into broad contact with each other. Thus, the pedestal 11 is stably held even when the body of the wearer moves while the pendant is worm, so that the decorative piece 30 always faces the front while the pendant is worn (see FIG. 14).

Reference numeral 17 denotes a suspension portion defined by a front portion of the pedestal 11 at substantially a central position thereof. A suspension hole 18, through which a loop ring 36 of the decorative piece 30 is passed and which extends generally parallel to a direction in which the through hole 13 extends, is formed at a tip portion 17*a* of the suspension portion 17. The suspension portion 17 is formed in a projecting manner from the head portion 12 to the tip portion 17*a*, with the tip portion 17*a* being located at a most extended position as seen from the side. On the other hand, a part of the suspension portion 17 located below the tip portion 17*a* is recessed rearward to form a curved portion 19.

Figure 9:
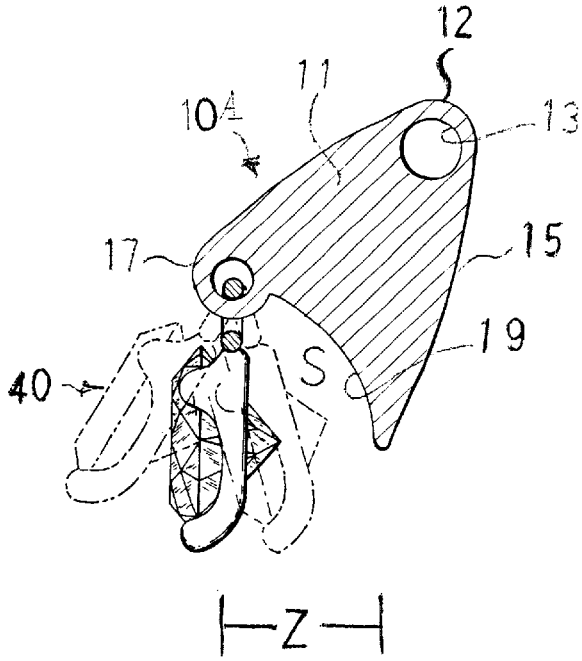
FIG. 9 is a central cross sectional view of the second jewelry pendant.

Thus, even when the decorative piece 30 is suspended from the suspension hole 18, it is securely held at a certain distance Z away from one end of the anchor portion 15 of the pedestal 11, and a space S is produced between the pedestal 11 and the decorative piece 30 (see FIG. 9). Therefore, there is prevented a situation where the decorative piece freely moves back and forth, or to the right and left, to cause a part of the decorative piece 30 to abut the pedestal 11 or the chest A of the wearer.

As shown in FIGS. 3 and 4, the first decorative piece 30 consists of a stopping ring 35 surrounding a girdle portion 32 of a jewel 31, and a loop ring 36 attached on top of the stopping ring 35. The loop ring 36 is passed through the suspension hole 18 of the pedestal 11 for engagement therewith, whereby the decorative piece 30 is suspended in a manner such that it can freely swing back and forth or to the right and left.

Since the decorative piece 30 is suspended by using the loop ring 36, sliding resistance with the suspension hole 18 is reduced and thus the decorative piece 30 can freely swing back and forth, or to the right and left, relative to the pedestal 11, thereby achieving a beautiful sparkle of the jewel 31.

Figure 5:
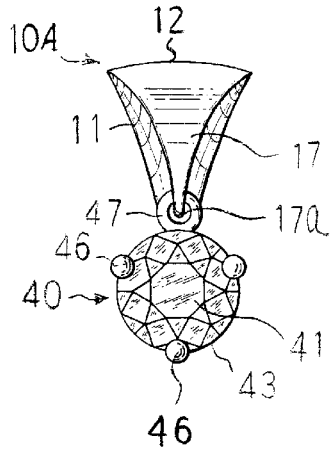
FIG. 5 is a front view of a second jewelry pendant according to the present invention.
Figure 6:
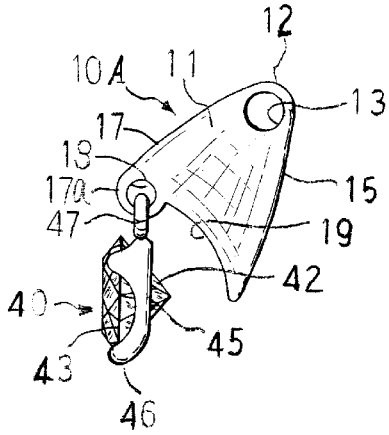
FIG. 6 is a side view of the second jewelry pendant according to the present invention.
Figure 7:
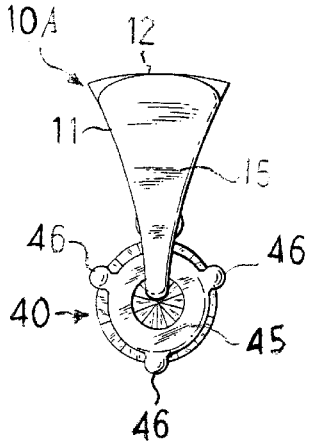
FIG. 7 is a rear view of the second jewelry pendant according to the present invention.

FIG. 5 shows a second embodiment of the present invention and is a front view of a second jewelry pendant in which a second decorative piece is mounted to the pedestal 11. FIG. 6 and FIG. 7 are a side view and a rear view thereof, respectively. Further, FIG. 8 is a front view illustrating a swinging state of the second jewelry pendant, and FIG. 9 is a central cross sectional view thereof.

Since the pedestal of a second jewelry pendant 10A is the same as that of the first jewelry pendant, the description thereof is omitted here.

As shown in FIGS. 5, 6, and 7, a second decorative piece 40 is formed such that a jewel 41 is held and fixed by virtue of a stopping ring 45 surrounding the jewel 41 and a plurality of claw portions 46. A loop ring 47 attached on top of the stopping ring 45 is passed through suspension hole 18 of the pedestal 11 for engagement therewith, whereby the second decorative piece 40 can be suspended in a manner such that it can swing back and forth or to the right and left.

In the second decorative piece 40 formed as above, it is desirable that the stopping ring 45 not surround a girdle portion 43 of the jewel 41, but rather surround a pavilion portion 42 which is located at a lower position of the jewel 41 and has a substantially conical configuration.

Further, it is desirable that three (or five) claw portions 46 be provided at a bottom edge and at obliquely upper right and left edges of the girdle portion 43, respectively, and that no claw portion 46 be provided at a top edge of the girdle portion 43.

With such an arrangement, the jewel 41 can be located at a more elevated position, with a result that distance L (see FIG. 8) from the suspension portion 17 to the bottom end of the jewel 41 can be made smaller. Therefore, even when the second decorative piece 40 is suspended from the suspension portion 17 of the pedestal 11, an overall vertical length X of the jewelry pendant does not become unnecessarily large, thereby realizing a jewelry pendant having well-balanced dimensions and a favorable shape as a whole.

Figure 10:
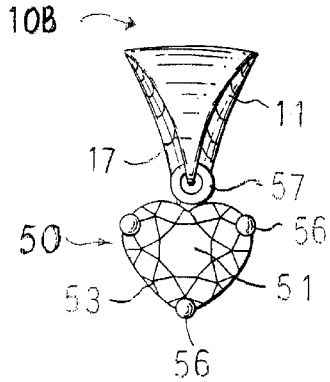
FIG. 10 is a front view of a third jewelry pendant according to the present invention.

FIG. 10 shows a third embodiment of the present invention and is a front view of a third jewelry pendant in which a third decorative piece is mounted to pedestal 11. Since the pedestal of a third jewelry pendant 10B is the same as the pedestal of the first jewelry pendant, description thereof is omitted here.

As shown in FIG. 10, a third decorative piece 50 is formed as follows. A jewel 51 is cut into a heart shape (i.e. a so-called heart-shape cut is performed), and a girdle portion 53 of the jewel 51 is held and fixed by virtue of a stopping ring (not shown) surrounding a pavilion portion of the jewel and a plurality of claw portions 56 supporting the jewel 51. A loop ring 57 attached on top of the stopping ring is then passed through the suspension hole 18 to be engaged therewith, whereby the third decorative piece 50 is suspended from the pedestal 11 in a manner such that it can swing back and forth or to the right and left.

The third decorative piece 50 is identical to the aforementioned second decorative piece 40 in that the stopping ring surrounds the pavilion portion of the jewel 51 and that three claw portions are provided, with none of the claw portions being provided at a top edge of the girdle portion.

Figure 11:
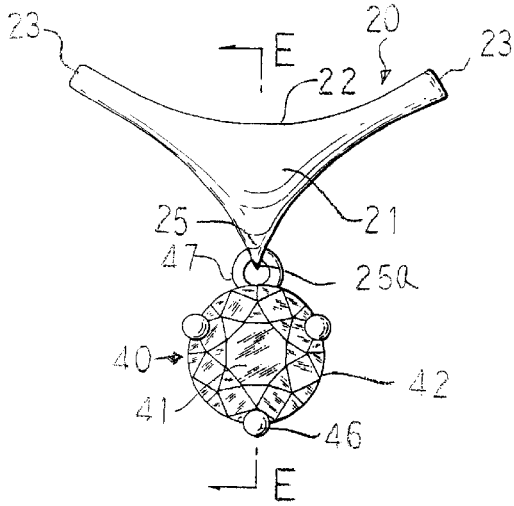
FIG. 11 is a front view of a fourth jewelry pendant according to the present invention.
Figure 12:
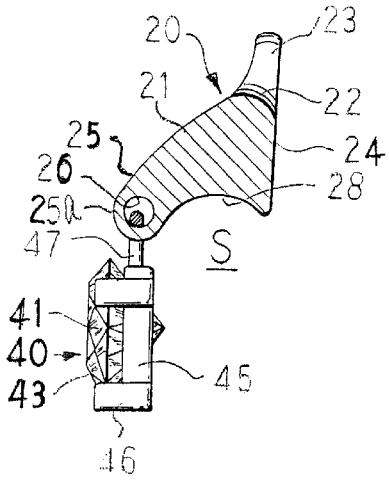
FIG. 12 is a cross sectional view taken along a line E—E in FIG. 11.

FIG. 11 shows a fourth embodiment of the present invention and is a front view of a fourth jewelry pendant 20 in which the second decorative piece is mounted to a second pedestal. FIG. 12 is a cross sectional view taken along a line E—E in FIG. 11.

In the fourth jewelry pendant 20, both upper side edges 22 of a pedestal 21 are spread like a wing as seen from the front to thereby form a chain connecting portion defined by oppositely extending extensions 23, as shown in FIG. 11. Both ends of a necklace chain are fixed to the chain connecting portion 23 by brazing or the like (not shown).

In this fourth jewelry pendant 20, the chain connecting portion 23 is widely spread apart to the right and left. Moreover, the necklace chain is also brought into contact with a chest of a wearer while the pendant is worm. Therefore, the pedestal 21 can be held stable in a reliable fashion even when the body of the wearer moves while the pendant is worm. Thus, decorative piece 50 always faces the front while the pendant is worn.

Reference numeral 24 denotes a flat anchor portion defined by a back portion of the pedestal 21, as shown in FIG. 12. When seen from the side, the anchor portion 24 is gently tapered in a vertical direction thereof. Similar to the aforementioned embodiments, the shape of the anchor portion 24 conforms with a curve A of the chest of the wearer while the pendant is worn, so that the anchor portion 24 and the chest A of the wearer can be brought into broad contact with each other.

Reference numeral 25 denotes a suspension portion defined by a front portion of the pedestal 21 at substantially a central position thereof. A suspension hole 26 through which a loop ring 47 of decorative piece 40 is passed is formed at a tip portion 25*a* of the suspension portion 25. The suspension portion 25 is formed in a projecting manner such that the tip portion 25*a* thereof sits at a most extended position as seen from the side. Further, similar to the aforementioned embodiments, a lower part of the suspension portion 25 is recessed rearwardly to form a curved portion 28, so that even when the decorative piece 40 is suspended from the suspension portion, a space S is produced with a result that even when the decorative piece 40 swings back and forth, a part thereof does not abut the pedestal 21.

In each of the embodiments, as is apparent from the drawings, the anchor portion is positioned generally between a level at which the chain connecting portion is positioned and a level at which the decorative piece is positioned.

Incidentally, it is needless to mention that the first decorative piece and the third decorative piece may also be suspended from the second pedestal in accordance with this embodiment.

As has been seen, the present invention has been explained based on a number of embodiments that are illustrated in the drawings. However, it is needless to mention that the present invention is not limited to the above-described embodiments and changes could be made to the embodiments through various modifications without departing from the sprit of the invention.

For example, there is no particular limitation on a material or a shape of the jewel that is mounted to the decorative piece in the jewelry pendant of the present invention. For example, a facet-cut jewel other than a diamond such as a ruby or an emerald, a semi-precious stone that is cut cabochon such as an opal, a round-shape configuration such as a pearl, or a precious stone such as a mirror ball may also be employed.

In the jewelry pendant according to the present invention, since the pedestal can be brought into broad contact with the chest of the wearer through the flat anchor portion, the pedestal can be stably held and thus the decorative piece always faces the front while the jewelry pendant is worn.

Further, since the suspension portion of the pedestal is formed such that it is projected at its tip and includes a curved portion in a lower rearward portion thereof, the decorative piece can freely swing back and forth or to the right and left, lending a beautiful sparkle to the jewel due to thus enhanced light reflection.

Further, in the case of the decorative piece to which the jewel is mounted by using claw portions, the stopping ring surrounds the pavilion portion of the jewel and no claw portion is provided at an upper location of the girdle portion of the jewel. Therefore, a distance between the pedestal and the decorative piece in a vertical direction thereof can be made smaller, thereby realizing a beautiful jewelry pendant having a good overall dimensional balance.

In addition, in the jewelry pendant of the type in which a necklace chain is fixed to both side edges of a chain connecting portion, the pedestal becomes even more stable so that subtle swing movements of the decorative piece can be more effectively realized.

What is claimed is:

1. A jewelry pendant comprising:

a pedestal having (i) a back portion defining an anchor portion, (ii) an upper portion defining a chain connecting portion, and (iii) a front portion defining a suspension portion having a suspension hole extending therethrough, with said back portion, upper portion and front portion being monolithic relative to one another;

a decorative piece swingably suspended from said suspension portion via said suspension hole; and a chain-like member connected to said chain connecting portion, wherein said anchor portion is positioned generally between a level at which said chain connecting portion is positioned and a level at which said decorative piece is positioned.

2. The jewelry pendant according to claim 1, wherein said pedestal is of a substantially inverted triangular shape when viewed in a direction from said front portion toward said back portion, said suspension portion is at a frontmost portion of said pedestal, and said pedestal also has a lower portion including a surface defining a recess rearwardly of said suspension portion, with said surface extending from said suspension portion to a location where said back portion merges with said lower portion, and said surface also facing in a direction away from said pedestal.

3. The jewelry pendant according to claim 2, wherein said anchor portion is gently tapered in a vertical direction as viewed from a side of said anchor portion.

4. The jewelry pendant according to claim 3, wherein said decorative piece includes (i) a jewel, (ii) a stopping ring surrounding a girdle portion of said jewel, and (iii) a loop ring above said stopping ring, and said decorative piece is swingably suspended from said suspension portion via said loop ring being engaged with said suspension hole.

5. The jewelry pendant according to claim 3, wherein said decorative piece includes (i) a jewel, (ii) plural claw portions supporting said jewel, (iii) a stopping ring surrounding a pavilion portion of said jewel, and (iv) a loop ring above said stopping ring, and said decorative piece is swingably suspended from said suspension portion via said loop ring being engaged with said suspension hole.

6. The jewelry pendant according to claim 2, wherein said decorative piece includes (i) a jewel, (ii) a stopping ring surrounding a girdle portion of said jewel, and (iii) a loop ring above said stopping ring, and said decorative piece is swingably suspended from said suspension portion via said loop ring being engaged with said suspension hole.

7. The jewelry pendant according to claim 2, wherein said decorative piece includes (i) a jewel, (ii) plural claw portions supporting said jewel, (iii) a stopping ring surrounding a pavilion portion of said jewel, and (iv) a loop ring above said stopping ring, and said decorative piece is swingably suspended from said suspension portion via said loop ring being engaged with said suspension hole.

8. The jewelry pendant according to claim 1, wherein said upper portion includes oppositely extending extensions as viewed from a front of said pedestal, with said oppositely extending extensions defining said chain connecting portion such that opposite ends of a necklace chain are to be fixed to said oppositely extending extensions, respectively, said suspension portion is at a frontmost portion of said pedestal, and said pedestal also has a lower portion including a surface defining a recess rearwardly of said suspension portion, with said surface extending from said suspension portion to a location where said back portion merges with said lower portion and said surface also facing in a direction away from said pedestal.

9. The jewelry pendant according to claim 8, wherein said anchor portion is gently tapered in a vertical direction as viewed from a side of said anchor portion.

10. The jewelry pendant according to claim 9, wherein said decorative piece includes (i) a jewel, (ii) a stopping ring surrounding a girdle portion of said jewel, and (iii) a loop ring above said stopping ring, and said decorative piece is swingably suspended from said suspension portion via said loop ring being engaged with said suspension hole.

11. The jewelry pendant according to claim 9, wherein said decorative piece includes (i) a jewel, (ii) plural claw portions supporting said jewel, (iii) a stopping ring surrounding a pavilion portion of said jewel, and (iv) a loop ring above said stopping ring, and said decorative piece is swingably suspended from said suspension portion via said loop ring being engaged with said suspension hole.

12. The jewelry pendant according to claim 8, wherein said decorative piece includes (i) a jewel, (ii) a stopping ring surrounding a girdle portion of said jewel, and (iii) a loop ring above said stopping ring, and said decorative piece is swingably suspended from said suspension portion via said loop ring being engaged with said suspension hole.

13. The jewelry pendant according to claim 8, wherein said decorative piece includes (i) a jewel, (ii) plural claw portions supporting said jewel, (iii) a stopping ring surrounding a pavilion portion of said jewel, and (iv) a loop ring above said stopping ring, and said decorative piece is swingably suspended from said suspension portion via said loop ring being engaged with said suspension hole.

14. The jewelry pendant according to claim 1, wherein said chain connecting portion includes a chain connecting hole extending therethrough such that a necklace chain is to be received within said chain connecting hole, with said chain connecting hole and said suspension hole extending generally parallel to each other, said suspension portion is at a frontmost portion of said pedestal, and said pedestal also has a lower portion including a surface defining a recess rearwardly of said suspension portion, with said surface extending from said suspension portion to a location where said back portion merges with said lower portion, and said surface also facing in a direction away from said pedestal.

15. The jewelry pendant according to claim 14, wherein said anchor portion is gently tapered in a vertical direction as viewed from a side of said anchor portion.

16. The jewelry pendant according to claim 15, wherein said decorative piece includes (i) a jewel, (ii) plural claw portions supporting said jewel, (iii) a stopping ring surrounding a pavilion portion of said jewel, and (iv) a loop ring above said stopping ring, and said decorative piece is swingably suspended from said suspension portion via said loop ring being engaged with said suspension hole.

17. The jewelry pendant according to claim 15, wherein said decorative piece includes (i) a jewel, (ii) a stopping ring surrounding a girdle portion of said jewel, and (iii) a loop ring above said stopping ring, and said decorative piece is swingably suspended from said suspension portion via said loop ring being engaged with said suspension hole.

18. The jewelry pendant according to claim 14, wherein said decorative piece includes (i) a jewel, (ii) a stopping ring surrounding a girdle portion of said jewel, and (iii) a loop ring above said stopping ring, and said decorative piece is swingably suspended from said suspension portion via said loop ring being engaged with said suspension hole.

19. The jewelry pendant according to claim 14, wherein said decorative piece includes (i) a jewel, (ii) plural claw portions supporting said jewel, (iii) a stopping ring surrounding a pavilion portion of said jewel, and (iv) a loop ring above said stopping ring, and said decorative piece is swingably suspended from said suspension portion via said loop ring being engaged with said suspension hole.

20. The jewelry pendant according to claim 1, wherein said decorative piece includes (i) a jewel, (ii) a stopping ring surrounding a girdle portion of said jewel, and (iii) a loop ring above said stopping ring, and said decorative piece is swingably suspended from said suspension portion via said loop ring being engaged with said suspension hole.

21. The jewelry pendant according to claim 1, wherein said decorative piece includes (i) a jewel, (ii) plural claw portions supporting said jewel, (iii) a stopping ring surrounding a pavilion portion of said jewel, and (iv) a loop ring above said stopping ring, and said decorative piece is swingably suspended from said suspension portion via said loop ring being engaged with said suspension hole.

22. The jewelry pendant according to claim 1, wherein said chain connecting portion includes a chain connecting hole, with an axis of said chain connecting hole being parallel with an axis of said suspension hole, and with said chain-like member passing through said chain connecting hole.

* * * * *